US007494552B2

(12) United States Patent
Benedictus et al.

(10) Patent No.: US 7,494,552 B2
(45) Date of Patent: Feb. 24, 2009

(54) AL-CU ALLOY WITH HIGH TOUGHNESS

(75) Inventors: Rinze Benedictus, PJ Delft (NL); Christian Joachim Keidel, Montabaur (DE); Alfred Ludwig Heinz, Niederahr (DE); Alfred Johann Peter Haszler, Vallendar (DE); Hinrich Johannes Wilhelm Hargarter, Alkmaar (NL)

(73) Assignee: Aleris Aluminum Koblenz GmbH, Koblenz (DE)

( * ) Notice: Subject to any disclaimer, the term of this patent is extended or adjusted under 35 U.S.C. 154(b) by 0 days.

(21) Appl. No.: 10/639,776

(22) Filed: Aug. 13, 2003

(65) Prior Publication Data

US 2004/0060618 A1 Apr. 1, 2004
US 2008/0060724 A2 Mar. 13, 2008

(30) Foreign Application Priority Data

Aug. 20, 2002 (EP) ..... 02078445

(51) Int. Cl.
*C22C 21/12* (2006.01)

(52) U.S. Cl. ..... 148/417; 420/533; 148/693

(58) Field of Classification Search ..... 148/417, 148/693; 420/533
See application file for complete search history.

(56) References Cited

U.S. PATENT DOCUMENTS

| | | | | |
|---|---|---|---|---|
| 3,826,688 | A | 7/1974 | Levy | |
| 4,294,625 | A | 10/1981 | Hyatt et al. | |
| 4,336,075 | A | 6/1982 | Quist et al. | |
| 5,213,639 | A * | 5/1993 | Colvin et al. | 148/693 |
| 5,376,192 | A | 12/1994 | Cassada, III | |
| 5,593,516 | A | 1/1997 | Cassada, III | |
| 5,759,302 | A | 6/1998 | Nakai et al. | |
| 5,863,359 | A | 1/1999 | Karabin et al. | |
| 5,865,914 | A | 2/1999 | Karabin et al. | |
| 5,879,475 | A | 3/1999 | Karabin | |
| 5,897,720 | A | 4/1999 | Dorward | |
| 5,938,867 | A | 8/1999 | Dorward et al. | |
| 6,077,363 | A * | 6/2000 | Heymes et al. | 148/417 |
| 6,277,219 | B1 * | 8/2001 | Heinz et al. | 148/552 |
| 6,325,869 | B1 | 12/2001 | Liu et al. | |
| 6,562,154 | B1 | 5/2003 | Rioja et al. | |
| 6,569,542 | B2 | 5/2003 | Warner et al. | |
| 6,602,361 | B2 | 8/2003 | Warner et al. | |
| 6,974,633 | B2 | 12/2005 | Garratt et al. | |
| 2001/0006082 | A1 | 7/2001 | Warner et al. | |
| 2002/0014288 | A1 | 2/2002 | Warner et al. | |
| 2002/0031681 | A1 * | 3/2002 | Heinz et al. | 428/654 |
| 2003/0070734 | A1 * | 4/2003 | Heinz et al. | 148/552 |
| 2003/0104990 | A1 | 6/2003 | Hauer et al. | |
| 2003/0140990 | A1 | 7/2003 | Ribes et al. | |
| 2004/0079455 | A1 | 4/2004 | Dif et al. | |
| 2004/0099353 | A1 * | 5/2004 | Benedictus et al. | 148/552 |
| 2004/0112480 | A1 * | 6/2004 | Benedictus et al. | 148/551 |

FOREIGN PATENT DOCUMENTS

| | | |
|---|---|---|
| EP | 0473122 | 3/1992 |
| EP | 489408 | 6/1992 |
| EP | 723033 | 7/1996 |
| EP | 0731185 | 9/1996 |
| EP | 0989195 | 3/2000 |
| EP | 1045043 | 10/2000 |
| EP | 1114877 | 7/2001 |
| EP | 1170394 | 1/2002 |
| EP | 1026270 | 2/2002 |
| EP | 1 045043 | 10/2002 |
| FR | 2789405 | 8/2000 |
| GB | 2352453 | 1/2001 |
| JP | 60 067636 | 4/1985 |
| JP | 60 251260 | 12/1985 |
| JP | 07252574 A * | 10/1995 |
| JP | 10017976 | 1/1998 |
| WO | 00 37702 | 6/2000 |
| WO | 2004 018721 | 3/2004 |

OTHER PUBLICATIONS

"Aluminum and Aluminum Alloys", ASM International, 1993, p. 63-64.*

"Metals Handbook: Desk Edition", ASM International, 1999, p. 1037.*

Davis, J.R., "ASM Specialty Handbook—Aluminum and Aluminum Alloys", Paper No. XP-002266795, ASM, Ohio (1996).

(Continued)

*Primary Examiner*—Roy King
*Assistant Examiner*—Janelle Morillo
(74) *Attorney, Agent, or Firm*—Novak Druce + Quigg LLP

(57) ABSTRACT

Disclosed is an Al—Cu alloy of the AA2000-series alloys with high toughness and an improved strength, including the following composition (in weight percent) Cu 4.5-5.5, Mg 0.5-1.6, Mn≦0.80, Zr≦0.18, Cr≦0.18, Si≦0.15, Fe≦0.15, the balance essentially aluminum and incidental elements and impurities, and wherein the amount (in weight %) of magnesium is either: (a) in a range of 1.0 to 1.6%, or alternatively (b) in a range of 0.50 to 1.2% when the amount of dispersoid forming elements such as Cr, Zr or Mn is controlled and (in weight %) in a range of 0.10 to 0.70%.

29 Claims, No Drawings

OTHER PUBLICATIONS

ASTM E112-96, Standard Test Methods for Determining Average Grain Size (1996).
J.R. Davis, "Metals Handbook-Desk Edition", p. 427 (2000).
N. Ridlev and J. Pilling, "Superplastic deformation characteristics of some commercial aluminium alloys", Aluminium Technology, London, Book 3, Session B, pp. 44.1-44.7 (Mar. 1986).
Davis, J.R., ASM Specialty Handbook, "Aluminium-Lithium Alloys", p. 121 May 1994.
Davis, J.R., ASM Specialty Handbook, "Aluminium and Aluminium Alloys", pp. 143-147 (1993).
"ASM Handbook: vol. 2 Properties and Selection: Nonferrous Alloys and Special-Purpose Materials", ASM International, pp. 70-79 (1990).
"ASM Handbook: vol. 9 Metallography and Microstructures", ASM International, pp. 364-365 (1985).
ASM Specialty Handbook, Aluminum and Alluminum Alloys, p. 29-30 (1993).
New Materials for Next-Generation Commercial Transports, National Materials Advisory Board, National Academy Press, p. 26 (1996).

* cited by examiner

AL-CU ALLOY WITH HIGH TOUGHNESS

FIELD OF THE INVENTION

The present invention relates to an aluminum-copper alloy having improved combinations of toughness and strength while maintaining good resistance to fatigue crack growth, a method for producing an aluminum-copper alloy with high toughness and an improved strength and to a rolled, forged or extruded aluminum-copper alloy sheet or plate product with high toughness and an improved strength for aeronautical applications. More specifically, the present invention relates to a high damage tolerant ("HDT") aluminum-copper alloy designated by the Aluminum Association ("AA")2xxx-series for structural aeronautical applications with improved properties such as fatigue crack growth resistance, strength and fracture toughness. The alloy according to the invention is preferably useful for aeronautical plate applications. More specifically, the invention relates to a rolled, forged or extruded alloy product suitable to be used as fuselage skin or lower wing skin of an aircraft.

BACKGROUND OF THE INVENTION

It is known in the art to use heat treatable aluminum alloys in a number of applications involving relatively high strength such as aircraft fuselages, vehicular members and other applications. Aluminum alloys AA2024, AA2324 and AA2524 are well known heat treatable aluminum alloys which have useful strength and toughness properties in T3, T39 and T351 tempers. Heat treatment is an important means for enhancing the strength of aluminum alloys. It is known in the art to vary the extent of enhancement by altering the type and amount of alloying constituents present. Copper and magnesium are two important alloying constituents.

The design of a commercial aircraft requires various properties for different types of structures on the aircraft. Especially for fuselage skin or lower wing skin it is necessary to have properties such as good resistance to crack propagation either in the form of fracture toughness or fatigue crack growth. At the same time the strength of the alloy should not be reduced. A rolled alloy product either used as a sheet or as a plate with an improved damage tolerance will improve the safety of the passengers, will reduce the weight of the aircraft and thereby improve the fuel economy which translates to a longer flight range, lower costs and less frequent maintenance intervals.

It is known in the art to have AA2x24 alloy compositions with the following broad chemistry, in weight percent:

| | |
|---|---|
| Cu | 3.7-4.4 |
| Mg | 1.2-1.8 |
| Mn | 0.15-0.9 |
| Cr | 0.05-0.10 |
| Si | ≦0.50 |
| Fe | ≦0.50 |
| Zn | ≦0.25 |
| Ti | ≦0.15 |

the balance aluminum and incidental impurities.

U.S. Pat. No. 5,593,516 discloses a high damage tolerant Al—Cu alloy with a balanced chemistry comprising essentially the following composition (in weight %):

| | |
|---|---|
| Cu | 2.5-5.5 |
| Mg | 0.1-2.3 |
| $Cu_{max}$ | −0.91 Mg + 5.59 |
| $Cu_{min}$ | −0.91 Mg + 4.59 |
| Zr | up to 0.2, or |
| Mn | up to 0.8 |

balance aluminum and unavoidable impurities. It also discloses T6 and T8 tempers of such alloys which gives high strength to a rolled product made of such alloy.

U.S. Pat. No. 5,897,720 and U.S. Pat. No. 5,938,867 disclose a high damage tolerant Al—Cu alloy with an "AA2024"-chemistry comprising essentially the following composition (in weight %):

| | |
|---|---|
| Cu: | 3.8-4.9 |
| Mg: | 1.2-1.8 |
| Mn: | 0.3-0.9 |

the balance aluminum and unavoidable impurities wherein the alloy is annealed after hot rolling at a temperature at which the intermetallics do not substantially dissolve. The annealing temperature is between 398° C. and 455° C. U.S. Pat. No. 5,938,867 also discloses an alloy where the ingot is inter-annealed after hot rolling with an anneal temperature of between 385° C. and 468° C.

EP-0473122, as well as U.S. Pat. No. 5,213,639, disclose an aluminum base alloy comprising essentially the following composition (in weight %):

| | |
|---|---|
| Cu | 3.8-4.5 |
| Mg | 1.2-1.8 |
| Mn | 0.3-0.9 |
| Fe | ≦0.12 |
| Si | ≦0.10 |

the remainder aluminum, incidental elements and impurities, wherein such aluminum base is hot rolled, heated and again hot rolled, thereby obtaining good combinations of strength together with high fracture toughness and a low fatigue crack growth rate. More specifically, U.S. Pat. No. 5,213,639 discloses an inter-anneal treatment after hot rolling the cast ingot with a temperature between 479° C. and 524° C. and again hot rolling the inter-annealed alloy. Such alloy appear to show a 5% improvement over the above mentioned conventional 2024-alloy in T-L fracture toughness and an improved fatigue crack growth resistance at certain ΔK-levels.

EP-1045043 describes an aluminum-copper alloy of the general 2024-type which is highly deformable and which comprises essentially the following composition (in weight %):

| | |
|---|---|
| Cu | 3.8-4.5 |
| Mg | 1.2-1.5 |
| Mn | 0.3-0.5 |

the remainder aluminum, incidental elements and impurities, wherein such aluminum alloy is preferably used for sheet applications with gauges in a range of 1.6-5.9 mm. Most examples given are directed to a reduced amount of copper, namely an amount (in weight %) of 3.9-4.2, thereby keeping the amount of magnesium above 1.2.

EP-1026270 discloses another 2024-type aluminum-copper alloy for aeronautical lower wing applications. Such alloy comprises essentially the following composition (in weight %):

| | |
|---|---|
| Cu | 3.8-4.4 |
| Mg | 1.0-1.5 |
| Mn | 0.5-0.8 |
| Zr | 0.08-0.15, |

the remainder aluminum, incidental elements and impurities. Such alloy shows an enhanced combination of strength, fatigue crack growth resistance, toughness and corrosion resistance. The alloy may be used for rolled, extruded or forged products wherein the addition of zirconium adds strength to the alloy composition ($R_m/R_p$ (L)>1.25).

EP-A-1114877 discloses another aluminum alloy composition of the AA2xxx-type alloys for fuselage skin and lower wing applications having essentially the following composition (in weight %):

| | |
|---|---|
| Cu | 4.6-5.3 |
| Mg | 0.1-0.5 |
| Mn | 0.15-0.45 |

the remainder aluminum, incidental elements and impurities. The method includes a solution heat treatment, stretching and annealing. Such alloy has been mentioned as being useful for thick plate applications such as wing structures of airplanes. The levels of magnesium are below 0.5 weight % wherein it is disclosed that such low magnesium level is advantageous for age formability. However, it is believed that such low magnesium levels have a negative influence with regard to the alloy's resistance to corrosion, its response to natural aging and its strength level.

U.S. Pat. No. 5,879,475 discloses an age-hardenable magnesium-copper-magnesium alloy suitable for aerospace applications. Such alloy comprises essentially the following composition (in weight %):

| | |
|---|---|
| Cu | 4.85-5.3 |
| Mg | 0.5-1.0 |
| Mn | 0.4-0.8 |
| Ag | 0.2-0.8 |
| Zr | 0.05-0.25 |
| Fe | ≦0.10 |
| Si | ≦0.10, |

the balance aluminum, incidental elements and impurities. The alloy is substantially vanadium-free and lithium-free wherein the non-presence of vanadium has been reported as being advantageous for the observed typical strength values. At the same time the addition of silver has been reported as to enhance the achievable strength levels of T6-type tempers. However, such alloy has the disadvantage that it is quite expensive for applications such as structural members of an aircraft even though it is reported to be suitable for higher temperature applications such as aircraft disc rotors, calipers, brake drums or other high temperature vehicular applications.

SUMMARY OF THE INVENTION

It is a preferred object of the present invention to provide a high damage tolerant AA2xxx-type alloy rolled product having improved combinations of toughness and strength while maintaining good resistance to fatigue crack growth and corrosion.

It is another preferred object of the present invention to provide aluminum alloy sheet products as well as plate products having an improved fracture toughness and resistance to fatigue crack growth for aircraft applications such as fuselage skin or lower-wing skin.

It is another preferred object of the present invention to provide rolled aluminum alloy sheet or plate products and a method for producing those products so as to provide structural members for aircrafts which have an increased toughness and resistance to fatigue crack growth while still maintaining high levels of strength.

More specifically, there is a general requirement for rolled AA2000-series aluminum alloys within the range of 2024 and 2524 alloys when used for aeronautical applications that the fatigue crack growth rate ("FCGR") should not be greater than a defined maximum. A FCGR which meets the requirements of high damage tolerance 2024-series alloy products is, e.g., FCGR below 0.001 mm/cycles at $\Delta K=20$ MPa$\sqrt{m}$ and 0.01 mm/cycles at $\Delta K=40$ MPa$\sqrt{m}$.

The present invention preferably solves one or more of the above-mentioned objects.

In accordance with the invention there is disclosed an aluminum-copper alloy rolled product with high toughness and an improved strength, comprising the following composition (in weight %):

| | |
|---|---|
| Cu | 4.5-5.5 |
| Mg | 0.5-1.6 |
| Mn | ≦0.80, and preferably ≦0.60 |
| Zr | ≦0.18 |
| Cr | ≦0.18 |
| Si | ≦0.15, and preferably <0.10 |
| Fe | ≦0.15, and preferably <0.10, |

a) the balance essentially aluminum and incidental elements and impurities, the alloy is substantially Ag-free, and wherein b) the amount (in weight %) of magnesium is in a range of 1.0 to 1.6, or alternatively the amount (in weight %) of magnesium is in a range of 0.50 to 1.2 and the amount of dispersoid forming elements, such as Cr, Zr or Mn, is controlled and (in weight %) is in a range of 0.10 to 0.70.

The alloy product of the present invention has preferably one or more dispersoid forming elements wherein the amount of these dispersoid forming elements, and which are preferably selected from the group consisting of Cr, Zr and Mn, is controlled and are present in a range of (in weight %) 0.10 to 0.70. By controlling the amount of dispersoid forming elements and/or by selecting a specific amount of magnesium it is possible to obtain a very high toughness by using high levels of copper thereby maintaining good strength levels, a good fatigue crack growth resistance and maintaining the corrosion resistance of the alloy product. Hence, the present invention either uses (i) an amount of magnesium which is above 1.0 (in weight %) but below 1.6 with or without dispersoid forming elements such as Cr, Zr and Mn, or alternatively (ii) the amount of magnesium is selected in range of below 1.2 while adding one or more dispersoid forming elements which are controlled in a specific range as described in more detail below.

The sum of added dispersoid forming elements (in weight %) of [Cr]+[Zr]+[Mn] is preferably in a range of 0.20 to 0.70, more preferably in a range of 0.35 to 0.55, and most preferably in a range of 0.35 to 0.45. The alloy of the present invention preferably comprises Mn-containing dispersoids wherein said Mn-containing dispersoids are in a more preferred embodiment at least partially replaced by Zr-containing dispersoids and/or by Cr-containing dispersoids. It has surprisingly been found that lower levels of manganese result in a higher toughness and an improved fatigue crack growth resistance. More specifically, the alloy product of the present invention has a significantly improved toughness while using low amounts of manganese and controlled amounts of magnesium. Hence, it is important to carefully control the chemistry of the alloy.

The amount (in weight %) of manganese is preferably in a range of 0.30 to 0.60, most preferably in a range of 0.45 to 0.55. The higher ranges are in particular preferred when no other dispersoid forming elements are present. Manganese contributes to or aids in grain size control during operations that can cause the alloy microstructure to recrystallize. The preferred levels of manganese are lower than those conventionally used in AA2×24-type alloys while still resulting in sufficient strength and improved toughness. Here, it is important to control the amount of manganese also in relation to other dispersoid forming elements such as zirconium or chromium.

The amount (in weight %) of copper is preferably in a range of 4.6 to 5.1. Copper is an important element for adding strength to the alloy. It has been found that a copper content of above 4.5 adds strength and toughness to the alloy while the formability and corrosion performance may still be balanced with the level of magnesium and the dispersoid forming elements.

The preferred amount (in weight %) of magnesium is either (i) in a range of 1.0 to 1.5, more preferably in a range of 1.0 to 1.2, or alternatively (ii) in a preferred range of 0.9 to 1.2, most preferably in a range of 1.0 to 1.2 when the amount of dispersoid forming elements such as Cr, Zr or Mn is controlled and (in weight %) in a range of 0.10 to 0.70. Magnesium provides also strength to the alloy product.

The preferred amount (in weight %) of zirconium is in a range of 0.08 to 0.15, most preferably in a range of about 0.10. The preferred amount (in weight %) of chromium is also in a range of 0.08 to 0.15, most preferably in a range of about 0.10. Zirconium may at least partially be replaced by chromium with the preferred proviso that [Zr]+[Cr]<0.30, and more preferably <0.25. Throughout the addition of zirconium more elongated grains may be obtained which also results in an improved fatigue crack growth resistance. The balance of zirconium and chromium as well as the partial replacement of Mn-containing dispersoids and Zr-containing dispersoids result in an improved recrystallization behavior.

Furthermore, throughout carefully controlling the dispersoid forming elements such as manganese, chromium and/or zirconium it is possible to balance strength versus toughness. By controlling these dispersoid forming elements the copper and magnesium window can be further extended to lower levels. While U.S. Pat. No. 5,593,516 is teaching to maintain the copper and magnesium level below the solubility limit it has surprisingly been found that it is possible to choose copper and magnesium levels above the solubility limit with controlling the dispersoid forming elements and hence obtaining very high values of toughness and maintaining good strength levels.

A preferred alloy composition of the present invention comprises the following composition (in weight %):

| | |
|---|---|
| Cu | 4.6-4.9 |
| Mn | 0.48-0.52 |
| Mg | 1.0-1.2 |
| Fe | <0.10 |
| Si | <0.10. |

Another preferred alloy according to the present invention comprises the following composition (in weight %):

| | |
|---|---|
| Cu | about 4.2 |
| Mn | 0.45-0.65 |
| Mg | 1.14-1.17 |
| Fe | <0.10 |
| Si | <0.10. |

Even more preferred an alloy according to the present invention comprises the following composition (in weight %):

| | |
|---|---|
| Cu: | 4.0-4.2 |
| Mn: | 0.30-0.32 |
| Mg: | 1.12-1.16 |
| Zr: | about 0.10 |
| Cr: | about 0.10 |
| Fe: | <0.10 |
| Si: | <0.10. |

The balance in the alloy product according to the invention is made by aluminum and inevitable impurities and incidental elements. Typically, each impurity element is present at 0.05% max., and the total of impurities should be below 0.20% max.

The alloy according to the present invention may further comprise one or more of the elements Zn, Hf, V, Sc, Ti or Li, the total amount less than 1.00 (in weight %), and preferably less than 0.50%. These additional elements may be added to further improve the balance of the chemistry and/or to enhance the forming of dispersoids.

The best results are achieved when the alloy rolled products have a recrystallized microstructure meaning that 75% or more, and preferably more than 80% of the grains in a T3 temper, e.g. T39 or T351, are recrystallized. In another aspect of the microstructure it has the grains have an average length to width aspect ratio of smaller than about 4 to 1, and typically smaller than about 3 to 1, and more preferably smaller than about 2 to 1. Observations of these grains may be done, for example, by optical microscopy at 50× to 100× in properly polished and etched samples observed through the thickness in the longitudinal orientation.

A method for producing an aluminum-copper alloy as set out above with high toughness and an improved strength according to the invention comprises the steps of:

a) casting an ingot with the following composition (in weight percent):

| | |
|---|---|
| Cu: | 4.5-5.5 |
| Mg: | 0.5-1.6 |
| Mn: | ≦0.80, and preferably ≦0.60 |
| Zr: | ≦0.18 |
| Cr: | ≦0.18 |
| Si: | ≦0.15, and preferably <0.10 |
| Fe: | ≦0.15, and preferably <0.10, |

the balance essentially aluminum and incidental elements and impurities, wherein a1) the amount (in weight %) of magnesium is in a range of 1.0 to 1.6, or a2) the amount (in weight %) of magnesium is in a range of 0.50 to 1.2 and the amount of dispersoid forming elements such as Cr, Zr or Mn is controlled and (in weight %) in a range of 0.10 to 0.70, b) homogenizing and/or pre-heating the ingot after casting, c) hot rolling or hot deforming the ingot and optionally cold rolling into a rolled product, d) solution heat treating, e) optionally quenching the heat treated product, f) stretching the quenched product, and g) naturally ageing the rolled and heat-treated product.

After hot rolling the ingot it is possible to anneal and/or reheat the hot rolled ingot and again hot rolling the rolled ingot. It is believed that such re-heating or annealing enhances the fatigue crack growth resistance by producing elongated grains which—when recrystallized—maintain a high level of toughness and good strength. It is furthermore possible to conduct a solution heat treatment between hot rolling and cold rolling at the same temperatures and times as during homogenization, e.g. 1 to 5 hours at 460° C. and about 24 hours at 490° C. The hot rolled ingot is preferably inter-annealed before and/or during cold rolling to further enhance the ordering of the grains. Such inter-annealing is preferably done at a gauge of app. 4.0 mm for 1 hour at 350° C. Furthermore, it is advisable to stretch the rolled and heat-treated product in a range of up to 10%, and preferably in a range of up to 4%, and more preferably in a range of 1 to 2%, and then naturally aging the stretched product for more than 5 days, preferably for about 10 to 15 days.

The present invention provides also a rolled, forged or extruded aluminum-copper alloy sheet or plate product with a high toughness and an improved strength with an alloy composition as described above or which is produced in accordance with the method as described above. The rolled alloy sheet product has preferably a gauge of around 2.0 mm to 12 mm for applications such as fuselage skin and about 25 mm to 50 mm for applications such as lower wing skin. For other structural members of the aircraft it is possible to use a rolled plate product according to the present invention from which aerospace structural parts may be machined. Hence, the present invention also supplies an improved aircraft structural member produced from a rolled, forged or extruded aluminum-copper alloy plate or sheet with an alloy composition as described above and/or produced in accordance with a method as described above.

The foregoing and other features and advantages of the alloy according to the present invention will become readily apparent from the following detailed description of some preferred embodiments.

EXAMPLE

On an industrial scale 7 different aluminum alloys have been cast into ingots having the following chemical composition as set out in TABLE 1.

TABLE 1

Chemical composition of the DC-cast aluminum alloys, in weight %, Si about 0.05%, Fe about 0.06%, balance aluminum and inevitable impurities.

| Alloy | Cu | Mn | Mg | Zr | Cr |
|---|---|---|---|---|---|
| AA2024 | 4.4 | 0.59 | 1.51 | 0 | 0 |
| AA2524 | 4.3 | 0.51 | 1.39 | 0 | 0 |
| 1 | 4.7 | 0.51 | 1.05 | 0 | 0 |
| 2 | 4.6 | 0.44 | 1.20 | 0.09 | 0 |
| 3 | 4.8 | 0.51 | 1.02 | 0 | 0 |
| 4 | 4.9 | 0.50 | 1.20 | 0 | 0 |
| 5* | 4.2 | 0.46 | 1.15 | 0 | 0 |
| 6* | 4.2 | 0.31 | 1.15 | 0 | 0.10 |
| 7 | 4.0 | 0.30 | 1.13 | 0.10 | 0 |

*hot deformation at different temperatures

The alloys have been processed to a 2.0 mm sheet in the T351 temper. The cast ingots were homogenized at about 490° C., and then hot rolled at 410° C. Alloys No. 5 and 6 hot deformed at about 460° C.

Thereafter, the plates were further cold rolled, solution heat treated and stretched by about 1%. All alloys have been tested at least after 10 days of natural aging. All alloys were tested in comparison with two reference alloys. As shown in Table 1 AA2024 and AA2524 alloys were used as reference alloys. Both reference alloys were processed in accordance with the above-mentioned method.

Thereafter, strength and toughness was tested. As shown in TABLES 2 and 3 the tensile yield strength in both L-direction and LT-direction as well as the ultimate tensile strength in L-direction and LT-direction have been tested. Furthermore, the unit propagation energy (UPE) in LT-direction and the notch toughness ($TS/R_p$) were tested in the LT-direction and TL-direction.

The testing was done in accordance with ASTM-B871 for the Kahn tear tests, and EN-10.002 for the tensile tests.

TABLE 2

Tensile properties (tensile yield strength $R_p$; ultimate tensile strength $R_m$) of Alloys 1 to 7 of Table 1 and reference alloys in the L and LT-direction.

| | L | | LT | |
|---|---|---|---|---|
| Alloy | Rp (MPa) | Rm (MPa) | Rp (MPa) | Rm (MPa) |
| AA2024 | 344 | 465 | 304 | 465 |
| AA2524 | 338 | 447 | 301 | 439 |
| 1 | 337 | 458 | 296 | 444 |
| 2 | 336 | 461 | 303 | 449 |
| 3 | 322 | 444 | 285 | 432 |
| 4 | 434 | 457 | 309 | 453 |
| 5 | 296 | 463 | — | — |
| 6 | 301 | 459 | — | — |
| 7 | 324 | 438 | 301 | 433 |

From the examples of Table 2 it can be seen that for the inventive alloys approx. the same strength levels can be obtained as for the reference alloys AA2024 and AA2524.

TABLE 3

Toughness properties (unit propagation energy, UPE; notch toughness TS/$R_p$) of Alloys 1 to 7 and reference alloys of Table 1 in the LT-direction and TL-direction

| | L-T | | T-L |
|---|---|---|---|
| Alloy | UPE (kJ/m$^2$) | TS/Rp | TS/Rp |
| AA2024 | 219 | 1.70 | 1.74 |
| AA2524 | 320 | 1.86 | 1.99 |
| 1 | 416 | 2.03 | 2.09 |
| 2 | 375 | 2.09 | 2.21 |
| 3 | 322 | 1.99 | 2.18 |
| 4 | 332 | 1.96 | 2.08 |
| 5 | 329 | 2.20 | — |
| 6 | 355 | 2.19 | — |
| 7 | 448 | 2.05 | 2.11 |

Table 3 shows that the Alloys 1 to 7 exhibit significantly higher toughness properties than the reference alloys M2024 or M2524. From alloys 6 and 7 it can be seen that lower levels of manganese and the replacement of Mn-forming dispersoids by Cr-forming dispersoids and/or Zr-forming dispersoids exhibit better properties than alloys with higher levels of manganese. At the same time it is possible to still maintain levels of manganese in a range of 0.50 to 0.55 when the levels of copper are above 4.5. In that case the toughness is as good as adding dispersoid forming elements and using lower levels of copper and manganese.

By balancing the levels of copper, magnesium and manganese it is possible to obtain a new group of alloys from the AA2000-series having a significantly higher toughness than prior art alloys. These alloys are specifically advantageous for aeronautical fuselage applications and lower wing skin applications.

Having now fully described the invention, it will be apparent to one of ordinary skill in the art that many changes and modifications can be made without departing from the scope or spirit of the invention as hereon described.

The invention claimed is:

1. Al—Cu alloy rolled product with a high toughness and an improved strength, consisting essentially of the following composition in weight percent:

| | |
|---|---|
| Cu | 4.6-4.9 |
| Mg | 1.05 to 1.15 |
| Mn | 0.44 to 0.51 |
| Zr | about 0 |
| Cr | about 0 |
| Si | <0.10 |
| Fe | <0.10, |

the balance aluminum and incidental elements and impurities, the alloy is substantially Ag-free, wherein the product has a microstructure wherein the grains have an average length to width ratio of smaller than about 4 to 1.

2. Alloy product according to claim 1, wherein the sum in weight % of [Cr]+[Zr]+[Mn] is in a range of 0.44 to 0.45%.

3. Alloy product according to claim 1, wherein the alloy product is in a T3 temper condition.

4. Alloy product according to claim 3, wherein the alloy product is in a T3 temper condition selected from the group consisting of T39 or T35 1 temper.

5. Alloy product according to claim 1, wherein the alloy product is recrystallized to at least 75%.

6. Alloy product according to claim 1, wherein said alloy product is recrystallized to at least 80%.

7. Alloy product according to claim 1, having a microstructure wherein the grains have an average length to width aspect ratio of smaller than about 3 to 1.

8. Alloy product according to claim 1, wherein the alloy product has a fatigue crack growth rate of less than 0.001 mm/cycles at $\Delta K$=20 MPa$\sqrt{m}$ when tested according to ASTM-E647 on 80 mm wide M(T) panels at R=0.1 at constant load and at a frequency of 8 Hz.

9. Alloy product according to claim 8, wherein the alloy product has a fatigue crack growth rate of less than 0.01 mm/cycles at $\Delta K$=40 MPa$\sqrt{m}$ when tested according to ASTM-E647 on 80 mm wide M(T) panels at R=0.1 at constant load and at a frequency of 8 Hz.

10. Alloy product according to claim 1, wherein the alloy product has a thickness in a range of 2.0 to 12 mm.

11. Alloy product according to claim 1, wherein the alloy product has a thickness in a range of 25 to 50 mm.

12. Alloy product according to claim 1, wherein the alloy product is processed into a fuselage sheet of an aircraft.

13. Alloy product according to claim 1, wherein the alloy product is processed into a lower-wing member of an aircraft.

14. Alloy product according to claim 1, wherein the dispersoid forming elements consist essentially of Mn.

15. Al—Cu alloy rolled product according to claim 1, with a high toughness and an improved strength, consisting of the following composition in weight percent:

| | |
|---|---|
| Cu | 4.6-4.9 |
| Mg | 1.05 to 1.15 |
| Mn | 0.44 to 0.51 |
| Zr | about 0 |
| Cr | about 0 |
| Si | <0.10 |
| Fe | <0.10 |

the balance essentially aluminum and incidental elements and impurities, the alloy is Ag-free.

16. Al—Cu alloy rolled product according to claim 1, with a high toughness and an improved strength, consisting of the following composition in weight percent:

| | |
|---|---|
| Cu | 4.6-4.9 |
| Mg | 1.05 to 1.15 |
| Mn | 0.44 to 0.51 |
| Zr | about 0 |
| Cr | about 0 |
| Si | <0.10 |
| Fe | <0.10 |

the balance essentially aluminum and incidental impurities, the alloy is substantially Ag-free, and wherein the sum of dispersoid forming elements is controlled and in weight % is in a range of 0.44 to 0.70%.

17. Alloy rolled product according to claim 16, wherein the dispersoid forming elements consist of Mn.

18. Alloy product according to claim 1, wherein the alloy product is in a T39 temper condition.

19. Alloy product according to claim 15, wherein the alloy product is in a T39 temper condition.

20. Alloy product according to claim 16, wherein the alloy product is in a T39 temper condition.

21. Al—Cu rolled product according to claim 15, with a high toughness and an improved strength, consisting of the following composition in weight percent:

| | |
|---|---|
| Cu | 4.6 to 4.9 |
| Mg | 1.05 to 1.15 |
| Mn | 0.44 to 0.51 |
| Zr | about 0 |
| Cr | about 0 |
| Si | at most about 0.05 |
| Fe | at most about 0.06, |

the balance essentially aluminum and incidental elements and impurities, the alloy is Ag-free.

22. Alloy product according to claim 1, wherein the Mn content in weight % is in a range of 0.45 to 0.51.

23. Alloy product according to claim 1, wherein the Zr content is 0 weight %.

24. Al—Cu alloy rolled product according to claim 1, with a high toughness and an improved strength, consisting essentially of the following composition in weight percent:

| | |
|---|---|
| Cu | 4.6 to 4.7 |
| Mg | 1.05 to 1.15 |
| Mn | 0.44 to 0.51 |
| Zr | about 0 |
| Cr | about 0 |
| Si | <0.10 |
| Fe | <0.10, |

the balance essentially aluminum and incidental elements and impurities, the alloy is Ag-free.

25. A method for producing an Al—Cu alloy according to claim 1, with a high toughness and an improved strength, comprising the steps of a) casting an ingot with the following composition consisting essentially of in weight percent:

| | |
|---|---|
| Cu | 4.6 to 4.9 |
| Mg | 1.05 to 1.15 |
| Mn | 0.44 to 0.51 |
| Zr | about 0 |
| Cr | about 0 |
| Si | <0.10 |
| Fe | <0.10, |

the balance essentially aluminum and incident elements and impurities, b) homogenizing and/or pre-heating the ingot after casting;

c) hot rolling or hot deforming the ingot and optionally cold rolling into a rolled product;

d) solution heat treating;

e) optionally quenching the heat treated product;

h) stretching the quenched product; and g) naturally ageing the rolled and heat-treated product.

26. Method according to claim 25, wherein after hot rolling the ingot, annealing and/or reheating the hot rolled ingot and again hot rolling the rolled ingot.

27. Method according to claim 25, wherein said hot rolled ingot is inter-annealed before and/or during cold rolling.

28. Method according to claim 25, wherein said rolled and heat-treated product is stretched in a range of up to 10% and naturally aged for more than 5 days.

29. Method according to claim 25, wherein in step f) the naturally ageing the rolled and heat-treated product is to provide a T3 temper condition.

* * * * *